United States Patent [19]

Fischer et al.

[11] Patent Number: 4,546,288

[45] Date of Patent: Oct. 8, 1985

[54] ARRANGEMENTS FOR FAST READOUT OF N STAGE ARRAYS OF GAS DISCHARGE CHAMBERS

[75] Inventors: Dieter Fischer, Frankfurt; Karl-Heinz Vatterott, Duderstadt, both of Fed. Rep. of Germany

[73] Assignee: Triumph-Adler Aktiengesellschaft bur Buro- und Informationstechnik, Nuremberg, Fed. Rep. of Germany

[21] Appl. No.: 498,461

[22] Filed: May 26, 1983

[51] Int. Cl.[4] ..... H01J 17/48; G09G 3/00

[52] U.S. Cl. ..... 315/169.4; 315/169.2; 340/714; 340/753; 340/802; 377/37; 377/55

[58] Field of Search ..... 377/56, 75, 76, 78, 377/79, 103, 99, 37, 55; 340/753, 758, 714, 802; 328/123, 124; 315/169.4, 169.2

[56] References Cited

U.S. PATENT DOCUMENTS

| | | | |
|---|---|---|---|
| 2,923,853 | 2/1960 | Engelbart | 377/78 |
| 3,581,065 | 5/1971 | Hatsukano | 377/37 |
| 3,648,102 | 3/1972 | Bettin | 377/78 |
| 3,991,341 | 11/1976 | Ngo | 315/169.2 |
| 4,009,414 | 2/1977 | Bockett-Pugh | 340/753 |
| 4,034,301 | 7/1977 | Kashio | 377/79 |
| 4,302,756 | 11/1981 | Frankland | 340/802 |
| 4,303,917 | 12/1981 | Kishino et al. | 340/758 |
| 4,325,064 | 4/1982 | Kishino et al. | 340/753 |

*Primary Examiner*—John S. Heyman

*Attorney, Agent, or Firm*—Joseph R. Spalla

[57] ABSTRACT

An n stage array of gas discharge chambers is divided into m groups of y stages each. Priming arrangements are provided whereby serial readout of the stages in each group can be accomplished simultaneously thereby increasing the speed of readout.

5 Claims, 4 Drawing Figures

G1
G2
Gm
A1
A2
Am
K0
K1
K2
K3
Ky
K2y
Kmy
0S
1
2
3
y-2
y-1
y
y+1
y+2
y+3
2y-2
2y-1
2y
(m-1)y+1
(m-1)y+2
(m-1)y+3
my-2
my-1
my
φ0
φ1
φ2
φ3

G1
G2
G3
VS
VR
B
C
D
φ0
φ1
φ2
φ3

ARRANGEMENTS FOR FAST READOUT OF N STAGE ARRAYS OF GAS DISCHARGE CHAMBERS

This invention relates to arrangements for fast readout of an n stage array of gas discharge chambers; more particularly it relates to an n stage array of gas discharge chambers divided into groups of stages and to arrangements for enabling the groups to be read out stage serially group parallel.

A related application is U.S. application of Dieter Fischer, Ser. No. 271,620 filed June 8, 1981 now U.S. Pat. No. 4,430,564 issued Feb. 7, 1984.

It is known that through use of priming wherein later stages are primed as a result of discharges in earlier stages of an array of gas discharge chambers, a minimum of address circuitry can be used to read out the gas discharge chambers sequentially. Such addressing techniques are disclosed for use in gas discharge display panels, (P. Haberland, J. Vac. Sci. Technol. Volume 10, No. 5 pgs 796–803 (1973)), and for use in electrostatic printers for control of writing styluses (Y. Terazawa, T. Hkubo, IEE Transactions on Electron. Devices Volume ED-21, No. 9, pages 593–597 (1974)). Furthermore, any insulator surface can be charged point by point to a defined potential. The speed of this charging is limited by the maximum step speed of the gas discharge shift register, which is governed by the physical parameters of the gas discharge and by the geometry of the arrangement.

In accordance with the invention a fixed number of neighboring cathodes associated with an n stage array of gas discharge chambers are combined into m groups of y stages. The number of cathodes in one group is preferably a multiple of the number of phase conductors whereby the corresponding cathodes of all groups in the series can be connected with the same phase conductor and controlled in a synchronous manner. Thus cathodes in a group are addressed sequentially with groups being addressed in parallel.

An object of the invention is in the provision of arrangements for increasing the speed of readout of an n stage array of gas discharge chambers.

A further object of the invention is to provide arrangements for priming the gas chambers of an n stage array of gas discharge chambers in which groups of stages can be read in parallel with stages in each group read serially.

Other objects, features and advantages of the present invention will become better known to those skilled in the art from a reading of the following detailed description when taken in conjunction with the accompanying drawing wherein like reference numerals designate like or corresponding elements throughout the several views thereof and wherein.

Figure 1:
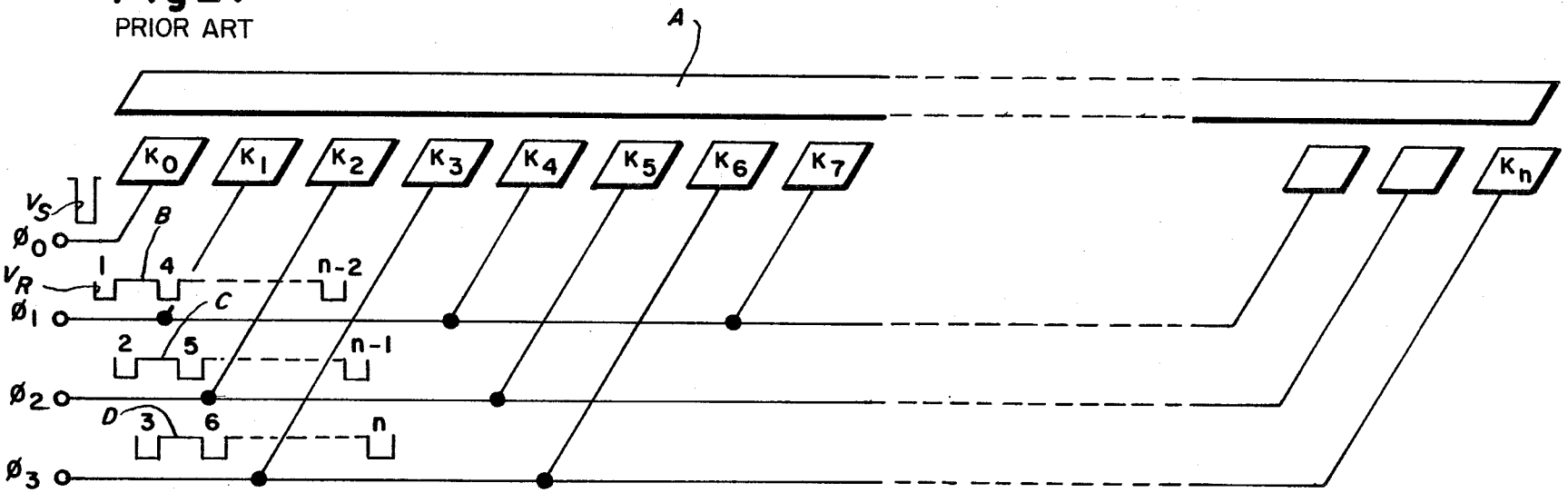
Fig 1 PRIOR ART
FIG. 1 is a block schematic of a prior art circuit arrangement for serially reading out an n stage array of gas discharge chambers.

Referring now to the drawings there is shown in FIG. 1 a prior art arrangement for serially reading out an n stage array of gas discharge chambers. The array of gas discharge chambers, as disclosed in said copending application, comprises an anode A and cathodes $K_o$–$K_n$. Anode A and cathode $K_o$ bound a start gas chamber $O_s$ and anode A and a serial array of cathodes $K_1$–$K_n$ bound gas chambers 1–n. To minimize cathode address circuitry the gas chambers 1–n are capable of being discharged only if primed before application of read voltages $V_R$ to the cathodes K. As shown in FIG. 1 a terminal $\phi_0$ is connected to the cathode $K_0$ of the initial or start gas chamber and terminals $\phi_1$, $\phi_2$ and $\phi_3$ are connected to cathodes $K_1$, $K_4$, $K_7$ - - - $K_n-2$, to cathodes $K_2$, $K_5$, $K_8$ - - - $K_n-1$ and to cathodes $K_3$, $K_6$, $K_9$, - - - $K_n$.

As described in said copending Fischer application three phase displaced trains B, C, and D of read voltage pulses $V_R$ totaling n pulses are applied respectively to the terminals $\phi_1$, $\phi_2$, $\phi_3$ to read out the n stages in turn. To assure that only one stage at a time is discharged, the magnitude of the read pulses $V_R$ is not sufficient to effect discharge of a gas chamber, unless it is conditioned or primed by the introduction of ions as a result of a discharge in an immediately preceding stage. Thus, the gas chambers are interconnected by channels to carry ions from a discharged gas chamber into the next following gas chamber.

A cycle starts with the application of an ignition or start voltage $V_S$ to the terminal wire $\phi_0$, whereby a gas discharge occurs between cathode $K_0$ and anode A. As the gas chambers are connected, during the gas discharge in the start gas chamber associated with cathode $K_0$ charge carriers diffuse from the gas chamber associated with $K_0$ into the gas chamber associated with cathode $K_1$ to prime the first gas chamber. After switching off the start voltage $V_S$ currently on $\phi_0$, the first read voltage pulse in train B is applied to terminal $\phi_1$. The read voltage pulse applied to terminal $\phi_1$ is less than $V_s$, yet is great enough to initiate a gas discharge in the gas chamber associated with cathode $K_1$ which has been primed as a result of discharge in the start gas chamber. No discharges are initiated in gas chambers associated with cathodes $K_4$, $K_7$, etc. which also are connected to terminal $\phi_1$ because these gas chambers are not primed or conditioned. Discharge in the gas chamber associated with $K_1$ conditions or primes the next gas chamber 2 associated with cathode $K_2$, so that a discharge occurs therein upon application of a read pulse 2 in pulse brain C to terminal $\phi_2$. The discharge in the chamber associated with cathode $K_2$ primes the third gas chamber which is discharged upon application of pulse 3 in pulse train D to terminal $\phi_3$ connected to cathode $K_3$. Application of voltage pulse 4 to terminal $\phi_1$, after the gas chamber associated with cathode $K_3$ has been discharged to prime the gas chamber associated with $K_4$ is ineffective to again discharge the gas chamber associated with cathode $K_1$ since the charge carrier concentration in the gas chamber associated with $K_1$ will have fallen sufficiently so that it is not again discharged. The recovery time of this charge carrier concentration essentially depends on the geometry of the gas discharge chambers, the type of gas and the prevailing relationships of potential after turning off a pulse on terminal $\phi_1$. The recovery time determines the maxium attainable step-speed of the shift register.

The gas discharge passes through the nth gas chamber associated with cathode $K_n$ via periodic repetition of the application of read voltage pulses trains B, C and D to phase terminals $\phi_1$, $\phi_2$, $\phi_3$. A new run of the process begins once again with the application of a start voltage $V_s$ to terminal $\phi_0$. If the shortest possible time between two steps is labelled as $\lambda$, then the time period of n $\lambda$ is necessary to serially read an n stage array of gas discharge chambers.

In accordance with the invention this time can be reduced considerably by dividing the n gas discharge chambers of the array into m groups each of which, excluding the start chamber associated with cathode $K_0$, contains an equal number y of gas chambers which is a multiple of the number of phase terminals.

Figure 2:
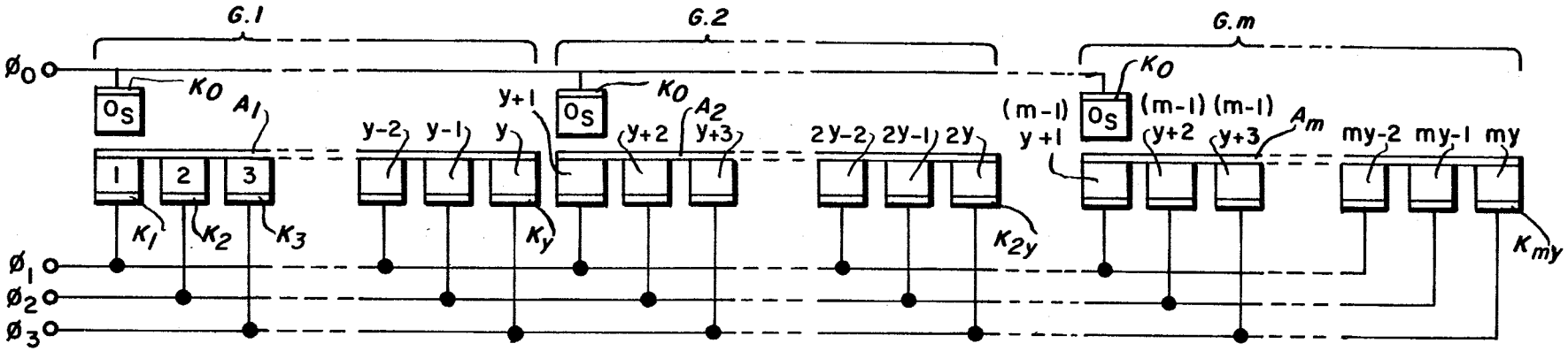
FIG. 2 is a block schematic of a circuit arrangement in accordance with the invention.

Referring to the embodiment of FIG. 2, there is shown an array of gas discharge chambers having the same number n of stages as in FIG. 1 and driven by phase terminals $\phi_1$, $\phi_2$ and $\phi_3$. The n stages are divided into groups m having y stages. Start terminal $\phi_0$ however is connected to a series of start gas chambers $\mathbf{0}_s$ which are interconnected with the first gas chamber in each of the groups m of y stages. The number of gas chambers y in a group is preferably a multiple of the number of phase terminals $\phi_1$, $\phi_2$ and $\phi_3$ for synchronous operation. Each group is also associated with a separate common anode $A_1$, $A_2$, - - - $A_m$.

Application of voltage to start terminal $\phi_0$ will cause discharges between the cathodes $K_0$ and the anodes associated with each group m. Discharges in the start gas chambers will prime the first gas chambers in each group, and thus serial read out of stages 1 - - - y of each group will occur simultaneously upon application of phase displaced pulse trains B, C and D to terminals $\phi_1$, $\phi_2$, and $\phi_3$ as in FIG. 1.

Referring now to FIG. 3 there is shown again an array of gas discharge chambers having n stages driven by phase displaced read voltage pulse trains B, C and D applied to terminals $\phi_1$, $\phi_2$, and $\phi_3$ as in FIG. 1. The n stages are again divided into groups m each of which has y stages (where my=n) and an associated Anode $A_1$, $A_2$ - - - Am. As in FIG. 1 this embodiment has a single start gas chamber $K_0$ at the beginning of the shift register connected to terminal $\phi_0$.

Figure 3:
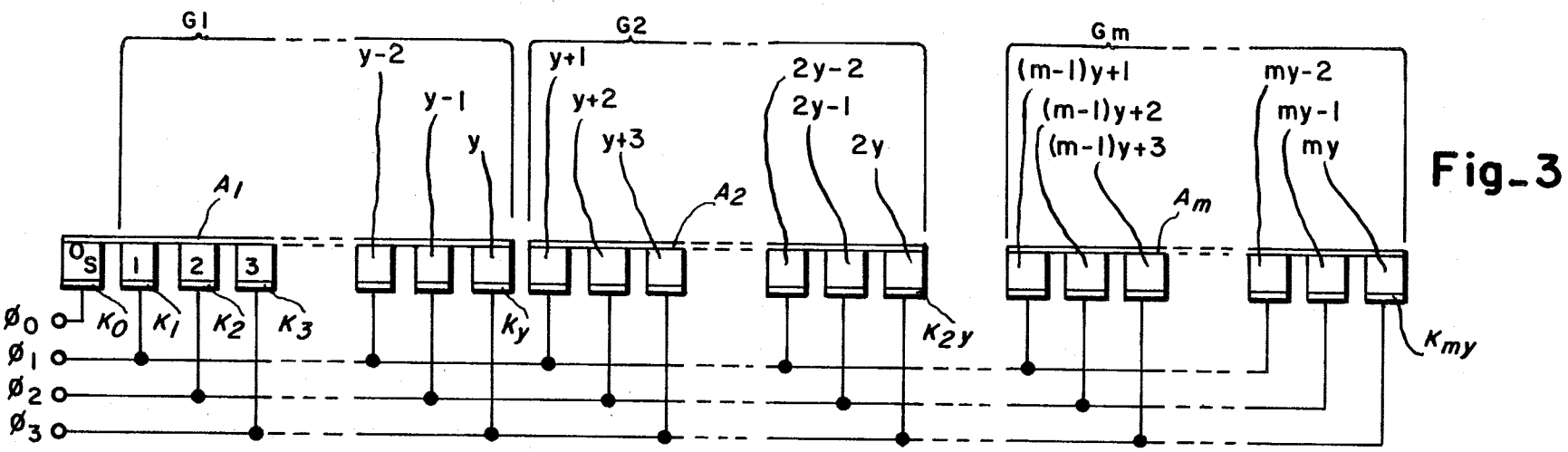
FIG. 3 is a block schematic of another preferred embodiment of a circuit arrangement according to the invention.

To read group parallel in the FIG. 3 embodiment requires the application of start voltage pulses $V_s$ to terminal $\phi_0$ simultaneously with read pulses $V_R$ applied to phase terminal $\phi_3$, whereby when the last chamber y in the first group G1 is discharged, thereby to prime the first chamber y+1 in the second group G2, the first gas chamber in the first group G1 is again primed and both groups G1 and G2 will be scanned simultaneously. Further when the last gas chambers y and 2y in the first and second groups are discharged, gas chamber y+1 in the second group, and 2y+1 in the 3rd group G3, will be primed for readout by a read voltage pulse on terminal $\phi_3$. Simultaneously a start pulse on start terminal $\phi_0$ will again prime the first gas chamber in Group G1 whereby Group G1, G2, and G3 will be scanned simultaneously by the 2y+1 - - - 3y pulses of pulse trains B, C and D. The process continues until the first stage in Group Gm is conditioned by discharge of the last stage in Group Gm−1 by a pulse on terminal $\phi_3$ generated simultaneously with a pulse on $\phi_1$. Thus all the groups are thereafter read out simultaneously read in parallel.

Figure 3A:
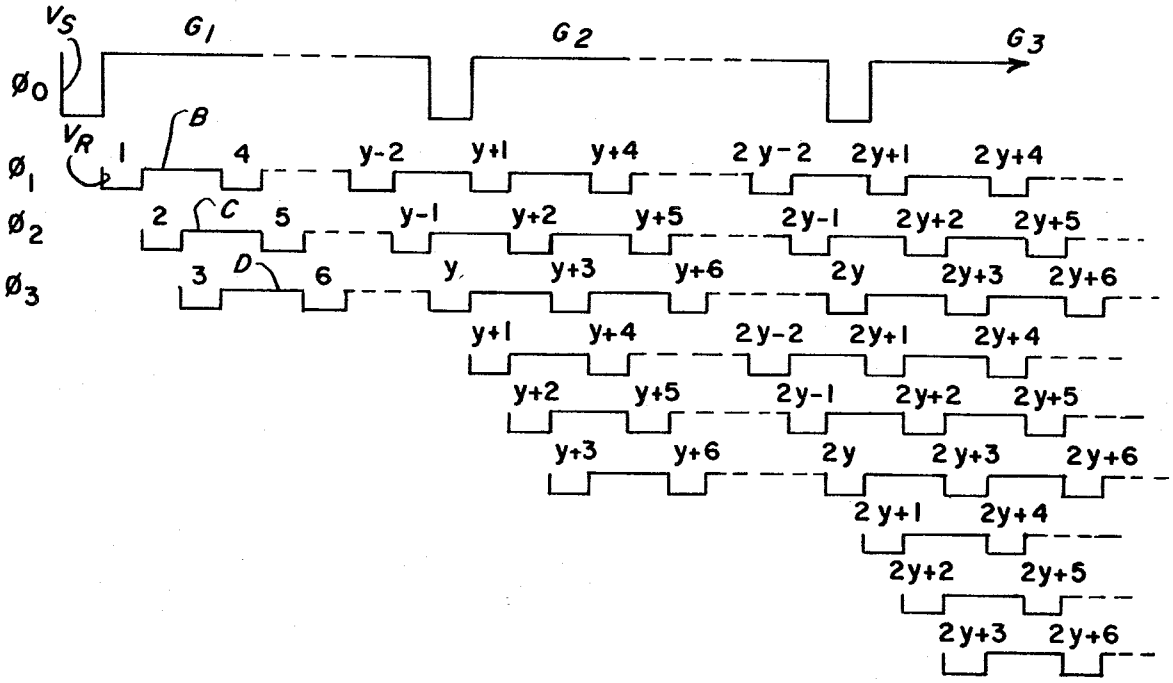
FIG. 3A is a timing diagram for the FIG. 3 embodiment.

The process is shown in the timing diagram of FIG. 3A wherein upon application of the pulse trains B, C and D, gas chambers 1 - - - y in the first group will be read out after y pulses, then gas chambers 1 - - - y in the first group and y+1 - - - 2y in the second group will be read out simultaneously in the next sequence of y+1 to 2y pulses. Then gas chambers 1 - - - y in the first group, y+1 to 2y in the second group, and 2y+1 to 3y in the third group will be read simultaneously in the next 2y+1 to 3y pulses, etc. until true parallel operation of all groups occur when the first chamber in the last group Gm is primed and all are read in parallel by a sequence of y pulses (M−1)y+1 - - - my on terminals $\phi_1$, $\phi_2$, $\phi_3$.

As will be appreciated, the arrangements according to the FIG. 3 embodiment of invention allow the speed of readout to increase by the factor m. It offers the advantage of arbitrarily choosing the run through time within a multiple of the number of phases by simply varying the cycle of $\phi_o$ and does not necessitate a change in circuit arrangement.

The invention claimed is:

1. Apparatus for fast readout of an n stage array of gas discharge chambers having m groups of y stages, said my stages comprising my interconnected gas chambers each bounded by an anode and a cathode, said gas chambers being adapted when primed by discharge of a preceding gas chamber to be discharged by voltage pulses of a magnitude insufficient to discharge unprimed gas chambers, multi phase lines for carrying trains of phase displaced voltage pulses totaling my pulses connected to said cathodes for sequentiaaly addressing said my cathodes, the number of stages y in each group being a multiple of said lines, and means for priming the first gas chamber in each of said groups whereby said groups are read out stage serially in parallel upon application of said voltage pulse trains.

2. Apparatus as recited in claim 1, said means for priming the first gas chambers in each of said groups comprising a start gas chamber interconnected with the first gas chamber in each of said groups, and a start line for applying a voltage of sufficient magnitude to discharge all of said start gas chambers in advance of application of said voltage pulse trains.

3. A gas discharge shift register as recited in claim 1, said means for priming the first gas chamber in each of said groups comprising a start gas chamber interconnected with the first gas chamber in the first group of said m groups, a start line for applying a voltage of sufficient magnitude to discharge said start gas chamber in advance of said voltage pulse train sequence, said start pulses thereafter occuring simultaneously with the y pulse igniting the last gas chamber in a group, whereby said first and second groups are primed simultaneously in the next y+1 to 2y sequence of the pulse train, and whereby said first, second and third groups are restarted simultaneously in the next following 2y++1 to 3y sequence of the pulse train and so forth until all groups are read out simultaneously with the $m^{th}$ group.

4. A gas discharge register as recited in claim 1, said lines being three in number and connected respectively to the first, fourth, seventh - - - $n^{th}$ −2 stage cathode, to the second, fifth eighth - - - $n^{th}$ −1 stage cathodes, and to the third, sixth, ninth - - - $n^{th}$ stage cathodes of each group.

5. A method for addressing an array of gas discharge chambers having n stages comprising the steps of dividing said n stages into groups having an equal number of stages, and priming the first chamber in each of said groups and thereafter serially addressing the stages in each group for simultaneously reading out said groups in parallel.

* * * * *